US006339905B1

(12) United States Patent
Craig

(10) Patent No.: US 6,339,905 B1
(45) Date of Patent: Jan. 22, 2002

(54) HINGELESS, PARALLEL STORING, SECTIONAL APERTURE COVERING

(76) Inventor: Clark Craig, 450 Weatherly Rd., Inman, SC (US)

( * ) Notice: Subject to any disclaimer, the term of this patent is extended or adjusted under 35 U.S.C. 154(b) by 0 days.

(21) Appl. No.: 09/357,140

(22) Filed: Jul. 20, 1999

Related U.S. Application Data

(60) Provisional application No. 60/093,319, filed on Jul. 20, 1998.

(51) Int. Cl.[7] ..... E04F 13/12

(52) U.S. Cl. ..... 52/174; 52/2.12; 52/202; 160/36; 160/33

(58) Field of Search ..... 52/2.11, 2.12, 52/202, 174; 160/36, 33, 32, 35, 34, 188

(56) References Cited

U.S. PATENT DOCUMENTS

| | | | | | |
|---|---|---|---|---|---|
| 1,009,046 | A | * | 11/1911 | Busch | 160/35 |
| 1,181,850 | A | * | 5/1916 | Cornelius | 160/32 |
| 1,492,420 | A | | 4/1924 | Burke et al. | |
| 1,788,651 | A | | 1/1931 | Alderson | |
| 2,167,306 | A | * | 7/1939 | Kundert | 160/33 |
| 2,729,287 | A | | 1/1956 | Goldner | |
| 2,850,089 | A | | 9/1958 | Burke | |
| 3,004,593 | A | | 10/1961 | Jeskin | |
| 3,451,163 | A | | 6/1969 | Malissa | |
| 3,795,205 | A | * | 3/1974 | Gritchen et al. | 105/450 |
| 3,980,123 | A | | 9/1976 | Vago | |
| 4,068,699 | A | | 1/1978 | Tucker | |
| 4,114,674 | A | | 9/1978 | Gabry | |
| 4,139,042 | A | * | 2/1979 | Watanabe et al. | 160/36 |
| 4,303,117 | A | * | 12/1981 | Lindbergh | 160/189 |
| 4,374,537 | A | * | 2/1983 | Lindbergh | 160/189 |
| 4,460,030 | A | * | 7/1984 | Tsunemura et al. | 160/35 |
| 4,538,661 | A | * | 9/1985 | Henry et al. | 160/35 |
| 4,662,420 | A | * | 5/1987 | Hirao | 160/32 |
| 4,795,206 | A | * | 1/1989 | Adams | 296/98 |
| 4,838,331 | A | * | 6/1989 | Kasai | 160/36 |
| 5,072,766 | A | * | 12/1991 | Kondoh et al. | 160/36 |
| 5,133,398 | A | * | 7/1992 | Yang et al. | 160/33 |
| 5,172,742 | A | * | 12/1992 | Iwasaki et al. | 160/36 |
| 5,284,199 | A | * | 2/1994 | Finch et al. | 160/133 |
| 5,564,164 | A | | 10/1996 | Jella | |
| 5,584,331 | A | * | 12/1996 | Lin | 160/172 |
| 5,588,475 | A | | 12/1996 | Martin | |
| 5,685,355 | A | * | 11/1997 | Cook et al. | 160/202 |
| 5,743,057 | A | | 4/1998 | Martin | |
| 5,782,283 | A | | 7/1998 | Kendall | |
| 5,819,834 | A | | 10/1998 | Wedekind | |
| 5,876,086 | A | | 3/1999 | Lagrou | |
| 5,915,446 | A | * | 6/1999 | De Zen | 160/235 |
| 5,957,181 | A | * | 9/1999 | Cohen-Ravid et al. | 160/32 |

* cited by examiner

*Primary Examiner*—Beth A. Stephan
*Assistant Examiner*—Phi Dieu Tran A
(74) *Attorney, Agent, or Firm*—Venable; Clifton E. McCann; Chad C. Anderson

(57) ABSTRACT

An aperture covering including track-guided interconnectable panels that are compactly stored in a storage area containing weight counterbalancing mechanisms, such as a compressed spring, is described. When the panels are stacked in the storage area and removed one at a time, the first panel is removed from the storage area and enters the track. As the first panel moves through the track, it interlocks with the second panel and forces the second panel out of the storage area and into the track. Interlocking and removal of the panels continues until all of the panels are removed or the first panel reaches the end of the track. Weight counterbalancing can be assisted by track-contained toothed belts, cable and ball drive mechanisms, or other counterbalancing methods. The resulting aperture covering requires minimal storage space for the open aperture position, minimizes exposure to potentially hazardous counterbalancing mechanisms, and allows for heavy-weight panel construction.

20 Claims, 13 Drawing Sheets

102
104
108
110a
112
114
116
100a
100b
100c
100d
100e 102
104
108
116
100a
100b
100c
100d
100e
110a

HINGELESS, PARALLEL STORING, SECTIONAL APERTURE COVERING

CROSS REFERENCE TO RELATED APPLICATION

This application claims the benefit of provisional Application Ser. No. 60/093,319, filed Jul. 20, 1998.

BACKGROUND OF THE INVENTION

1. Field of the Invention

The following invention relates generally to aperture coverings and specifically to garage doors.

2. Related Art

In the interest of brevity, conventional garage doors will first be explained. There are three garage door types that constitute the bulk of those currently used in the United States. The technical names for each type vary, so the generic names will be used.

The most commonly used door for both commercial and domestic purposes is the sectional door. This door includes horizontal panels which are hinged together along their lengths. These panels may be either solid or may contain windows. The ends of each panel terminate in at least one free turning wheel which travels in a track. A system of counterbalancing is usually employed. One system consists of a cable wound around an overhead drum which is attached to a shaft upon which is a torsion spring. The other end of the cable is attached to the bottom edge of the door. Another system uses extension springs which are fully extended when the door is in the down or closed position with the door down. Parts of these counterbalancing systems can break with explosive force, creating a hazard that could result in severe injury or death. When this door is in the up or open position, it hangs from the track horizontally, overhead and parallel to the garage floor. When it is closed, the track and the drive mechanism remain hanging from the garage ceiling. This precludes the use of this overhead space for storage or recreational purposes.

The California door is the second most common garage door. When closed, this door can appear like a sectional door. This door can be monolithic, however. Since it can be made in one piece, it can have better weatherproof qualities and can possibly be made less expensively than the sectional door The California door pivots as a unit from the open to closed position. When open, the California door is suspended overhead and situated parallel to the garage floor, much like the sectional door. This door can be dangerous. Besides the danger of flying spring parts, if the springs fail, the full weight of the door can guillotine down through the doorway, creating a hazard that could result in serious injury or death. As with the sectional door, the brackets, drives and door itself exclude the fall use of overhead garage space.

For commercial use, the roll up door is one of the more popular designs. It wraps around a counterbalancing spring and is stored in a cylindrical canister above the doorway when not in use. Very little usable garage space is taken by the roll up door mechanism. This would be an ideal door except for two factors: 1) the door must be rolled up tightly, and 2) it is difficult to include windows in a roll up door. With regard to the first issue, to achieve a small storage canister diameter, the door must roll up tightly. Consequently, the individual panels have to be very narrow. These slats are approximately 1 to 2" wide, as opposed to the 12 to 18" width common in sectional doors. The narrow slats give the door the appearance of a tambour door, like that commonly used on a roll top desk. Many home owners find this look aesthetically unappealing. With regard to the second issue of windows, the narrow slats also make it difficult to include wide windows in the door like those windows preferred by most homeowners.

While not typically used as a garage door, the prior art teaches a method for covering an aperture with interlocking, track-contained slats that disengage when stored in the aperture open position. The slat design employs minimal counterbalancing mechanisms. This method conserves storage space and eliminates exposure to hazardous counterbalance components, but the minimal use of counterbalancing components does not effectively prevent slat jamming within the track, particularly when heavyweight slats are being moved from the aperture closed to aperture open position.

What is needed is an aperture covering that eliminates the hazardous conditions created by uncontained, exposed, drive and counterbalance components, while minimizing the amount of overhead space encumbered by the stored covering, allowing for panels large enough to contain aesthetically pleasing windows, and still providing sufficient counterbalancing of the aperture cover such that the aperture covering can be opened without jamming. These and other shortcomings of conventional doors are addressed by the present invention.

SUMMARY OF THE INVENTION

The present invention is directed to an aperture covering composed of counterbalanced individual interlocking panels that are disengaged when stored. In an embodiment of the invention, an aperture covering includes at least two interconnectable panels, each panel having a surface that defines more than one notch, a storage area for storing the panels when the covering is in an open position, at least one track positioned along a path within which edges of the panels move when the cover is moved from an open to a closed position, and a toothed belt which is positioned in the track and which mates with the panel notches, where the panels are stacked in the storage area and removed one at a time in such a manner that, upon removal of a first panel from the storage area and into the track, the first panel interlocks with a second panel, forcing the second panel from the storage area and into the track, where interlocking and removal of the panels continues until all of the panels are removed or the first panel reaches the end of the track.

In another embodiment, a drive mechanism that exerts force upon one or more cables, track-contained rather than notched belts, is coupled to the panels.

In yet another embodiment, weight counterbalancing can be assisted by track-contained toothed belts, cable and ball drive mechanisms, or other counterbalancing methods.

BRIEF DESCRIPTION OF THE FIGURES

The present invention will be described with reference to the accompanying drawings, wherein.

DETAILED DESCRIPTION OF THE INVENTION

In the following description of the preferred embodiments, reference is made to the accompanying drawings which form a part hereof. The description shows by way of illustration specific illustrative embodiments in which the invention may be practiced. These embodiments are described in sufficient detail to enable those skilled in the art to practice the invention, and it is to be understood that other embodiments may be utilized and that logical, mechanical and electrical changes maybe made without departing from the spirit and scope of the present invention. The following detailed description is, therefore, not to be taken in a limiting sense.

The invention provides for panels to be stored and retrieved while staying in a plane that is substantially parallel to the plane created by the door when fully deployed. The invention is not limited to parallelism but can include panel counterbalancing mechanisms which allow for panel construction from heavyweight materials. The invention can include other embodiments where other, non-parallel configurations, such as deployment on curved tracks or perpendicular storage of the dissembled sections are advantageous. Additionally, other embodiments of the invention include individual panels that are curved in one or more planes.

Figures 1A, 1B, 1C, 1D, 1E, 1F, 1G, 1H, 1I:
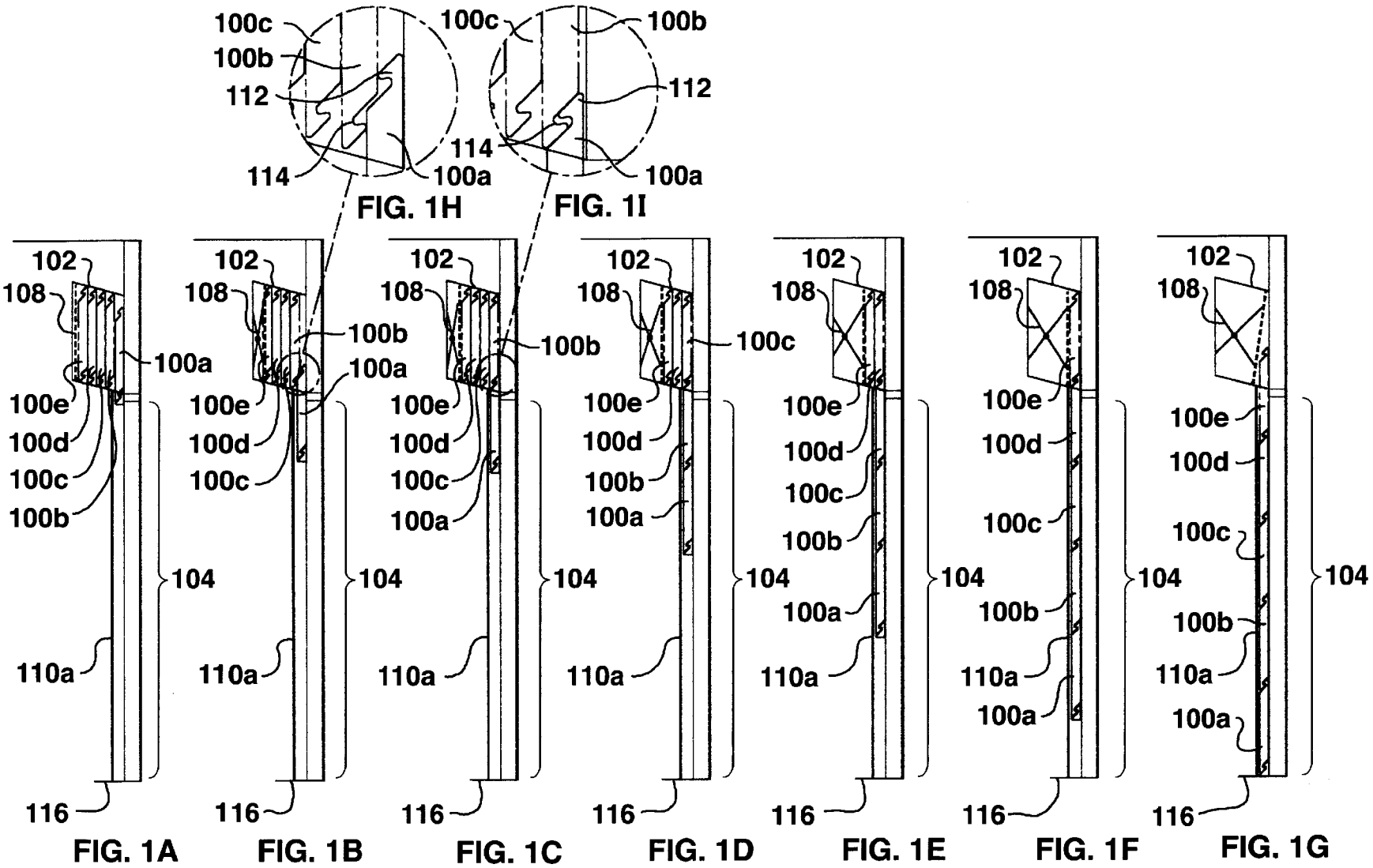
FIGS. 1A–1I is a side elevation of the series of steps for lowering the wall panel system.
Figure 7:
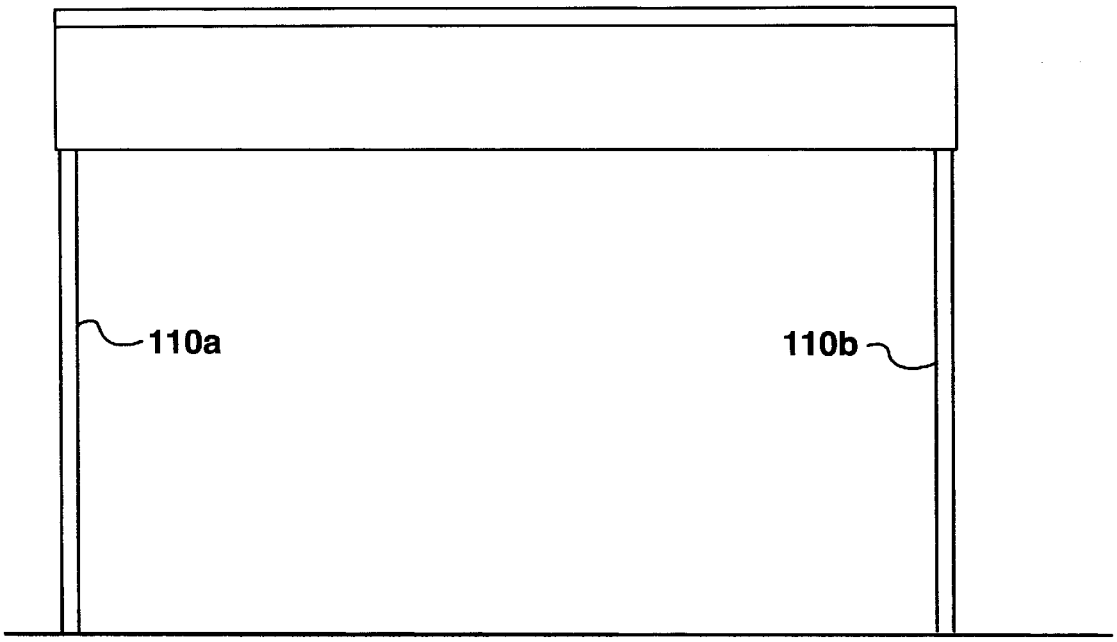
FIG. 7 is an elevational view of the wall panel system in a raised position.

In FIGS. 1A–1G, the sequence of figures represents an exemplary cross-section of an aperture covering as viewed from the left side. Hereinafter right and left refer to one's perspective outside of the garage looking toward the door. FIGS. 1A through 1G progressively show positions of the covering as it moves from an open to closed position. FIG. 1A shows the covering in its full open position. In this position, all of the panels 100*a–e* are stacked one against the other in parallel fashion in the diamond shaped storage box 102 above the aperture 104. The panels 100*a–e* are completely independent of each other with no hinges, cables or other means of connection. The front most panel 100*a* is partially deployed and held there by the counterbalancing mechanism 108, which is explained later. As shown in FIG. 7, left rim track 110*a* and right rim track 110*b* capture the last few inches of each end of the panels to guide their deployment and prevent panel disassembly when in use.

In FIGS. 1A–1G, the covering deployment process is disclosed. There is a compressed spring or other biasing mechanism 108 at the rear of the storage container 102. A sloping bottom on the storage container 102 gives a gravity assist to deployment of the panels 100*a–e*. The compressed spring biasing mechanism 108 is used together or separately with additional biasing mechanisms (see FIG. 3 and FIG. 4), as the application requires. The biasing forces push the panel 100*a–e* faces together within the storage container 102. As an operator pulls the first panel 100*a* down (see FIG. 1B) the hook-like nose 112 of the first panel 100*a* slides into engagement with the mating groove 114 of the panel 100*b* which it is sliding against (see detailed views 1H and 1I), since the first panel 100*a* never leaves the tracks 110*a* and 110*b* (only the left track 110*a* is illustrated), first panel 100*a* guides the second panel 100*b* into the top of the tracks 110*a* and 110*b* (see FIG. 1D), the front bottom edge of the storage container 102 being the terminus of the tracks 110*a* and 110*b*. Likewise, once the second panel 100*b* is in the tracks 110*a* and 110*b*, track 100*b* will engage (see FIG. 1D) and guide the third panel 100*c* into the tracks 110*a* and 110*b* (see FIG. 1E), and so on until all of the panels 100*a–e* are deployed and the first panel 100*a* contacts the aperture floor 116 (see FIG. 1G).

Figures 2A, 2B, 2C, 2D, 2E, 2F, 2G, 2H, 2I, 2J, 2K:
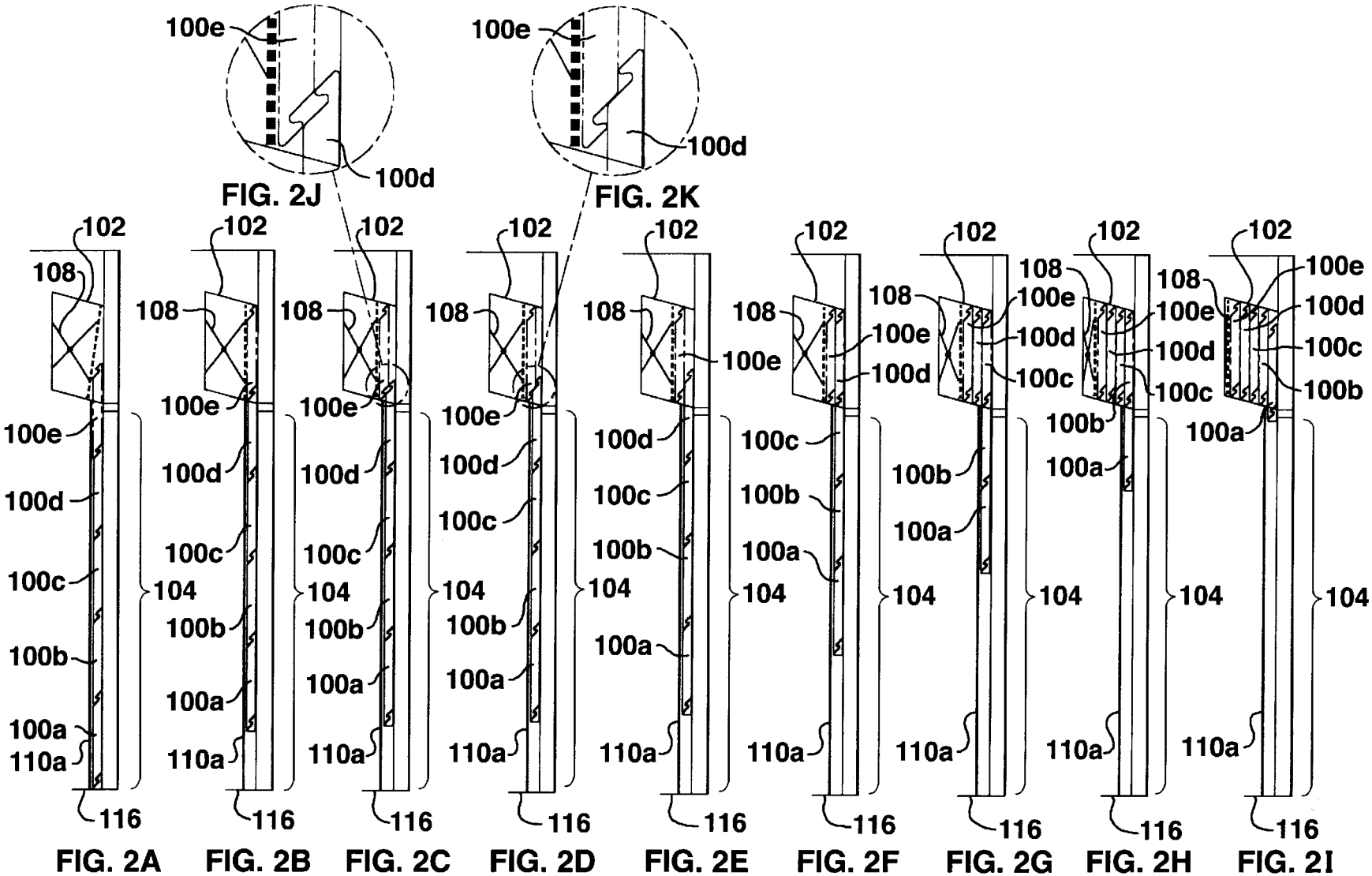
FIGS. 2A–2K is a side elevation of the series of steps for raising the panel wall system.

FIGS. 2A–2G illustrate an example of aperture covering storage, the reverse of the deployment procedure. An operator lifting on the first panel 100*a* will be aided by the compressed spring counterbalancing system 108 and any additional counterbalancing mechanisms (see FIG. 3 and FIG. 4). This system not only offsets much of the combined weight of the panels 100*a–e*, but also prevents the panels 100*a–e* from wedging themselves apart in the tracks 110*a* and 110*b* (only the left track 110*a* is illustrated) and jamming the aperture covering. In FIG. 2A, the panels 100*a–e* are deployed except for a portion of the top panel 100*e*. This panel 100*e* is holding the expanded biasing mechanism 108 open. As the top panel 100*e* is pushed up by the panels 100*a–d* below it 100*e* and the counterbalancing system 108, top panel 100*e* has to stop against the top of the storage container 102 (see FIG. 2B). In detailed drawing 2J, the top panel 100*e* has contacted the top of the storage container 102 and the second panel 100*d* below top panel 100*e* is beginning to force top panel 100*e* out of engagement. In detailed drawing 2K, the disengagement is concluded. In FIG. 2E, the panel 100*d* has pushed completely past and forced the top panel 100*e* against the biasing mechanism 108. FIGS. 2F, 2G, 2H and 21 show the panels 100*a–d* sequentially disassembling and storing themselves 100*a–d* in the overhead container 102.

Remaining FIGS. 7 through 19 and FIGS. 20 through 23 show other examples of installed aperture coverings, illustrating that the covering stores completely out of the way, while permitting the use of a panel and window style that homeowners typically prefer. Furthermore, since most or all of the drive and counterbalance parts can be contained in the storage box above the panels, there is little danger of injury due to exposed components.

Figure 3:
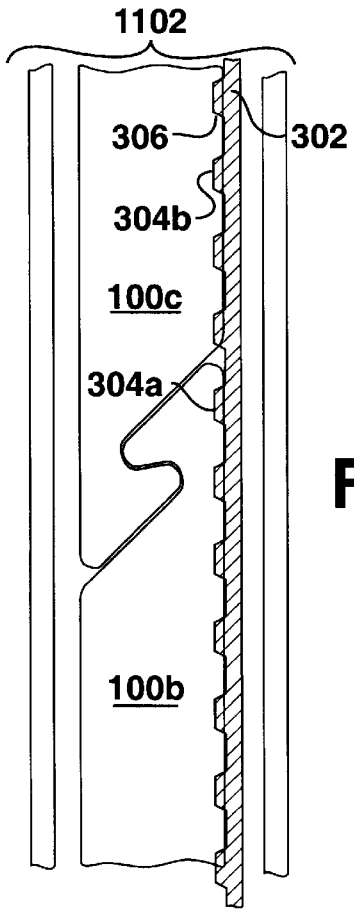
FIG. 3 is a broken-away sectional view of the drive element of the wall panel system.

FIG. 3 illustrates an exemplary view of an aperture covering from the left side. Track 100*a* prevents panels 100*b* and 100*c* from moving in any direction other than up or down. The panels 100*b* and 100*c* also cannot disengage because they cannot move forward or backward far enough to do so. There is a toothed belt 302 at the front of the track 110*a* that engages notches in the end caps 304*a* or in the faces 304*b* of the covering panels 100*b* and 100*c*. This belt 302 can be permanently attached to the bottom panel of the door on one end. In one unillustrated embodiment, one end is coiled in spiral fashion around a flanged drum attached to a horizontal shaft which rotates in bearings within a compartment above the panel storage box. The shaft can have a torsion spring wound around it in such a way as to offset all or a portion of the weight of the covering panels. In FIG. 3, both ends of the panels 100*b* and 100*c* are confined in the front, back, and sides by the tracks 110*a* and 110*b* (only 110*a* is illustrated) and toothed belts 302 engaging them 100*b* and 100*c* on both ends. These belts 302 are biased to offset the panel 100*b* and 100*c* weight by wrapping the belts 302 around drums attached to a common shaft. Both panel 100*b* and 100*c* ends will move in synchronous fashion up and down within the track 110*a* The panels 100*b* and 100*c* are prevented from moving up or down relative to each other within the tracks 110*a* and 110*b* because they are engaged in the notches 306 of a common belt 302. This prevents panels 100*b* and 100*c* from wedging apart and possibly jamming within the track 110*a*.

Figure 4:
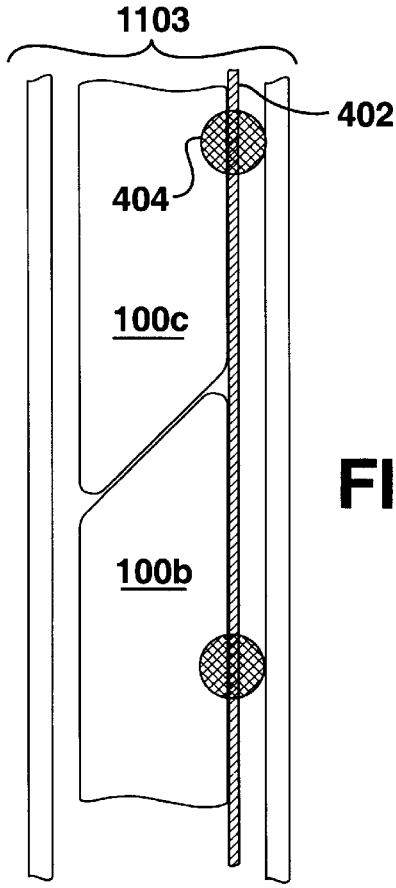
FIG. 4 is a broken-away sectional view of second embodiment of the drive element of the wall panel system.
Figure 5:
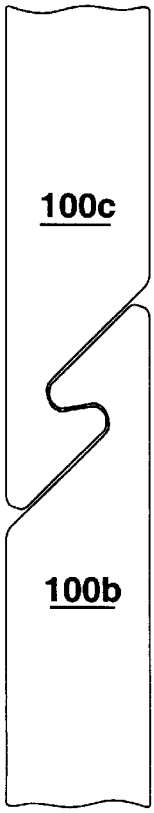
FIG. 5 is a broken-away sectional view of a joint section of the wall panel system.
Figure 6:
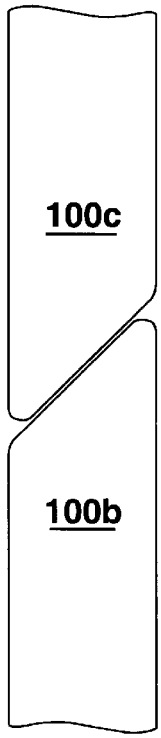
FIG. 6 is a broken-away sectional view of a second embodiment of the joint section of the wall panel system.

In FIG. 4 a simplified exemplary cable 402 and ball 404 drive is shown as another mechanism for counterbalancing the panels 100*b* and 100*c*. Many different drive types can be used. In some applications, a drive or counterbalancing system is not needed or desired.

Many of the motorized drive systems in use today can be adapted to automate the invention, as embodied in FIG. 4. In one unillustrated embodiment, a motorized drive system is situated in a compartment within or above the storage container where the mechanism would turn the counterbalance shaft in one direction to lower the door and in the other to raise it. In another unillustrated embodiment, commonly used remote controls and security locks are integrated into the design.

Figure 8:
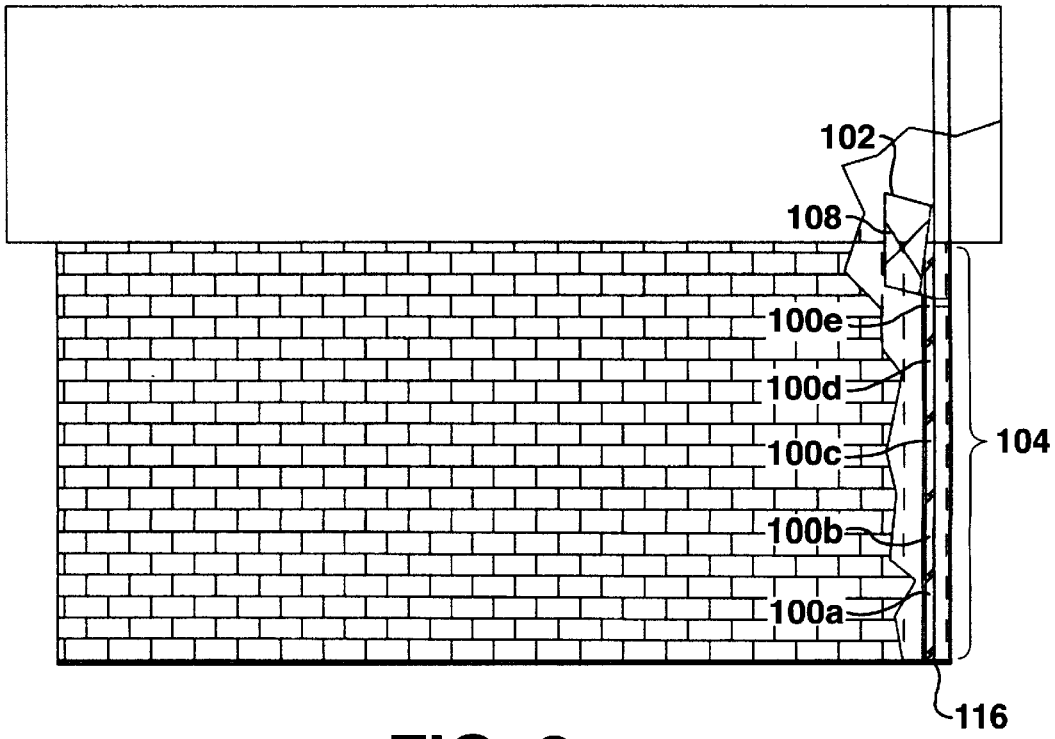
FIG. 8 is a broken-away side elevational view of the wall panel system in a lowered position.
Figure 9:
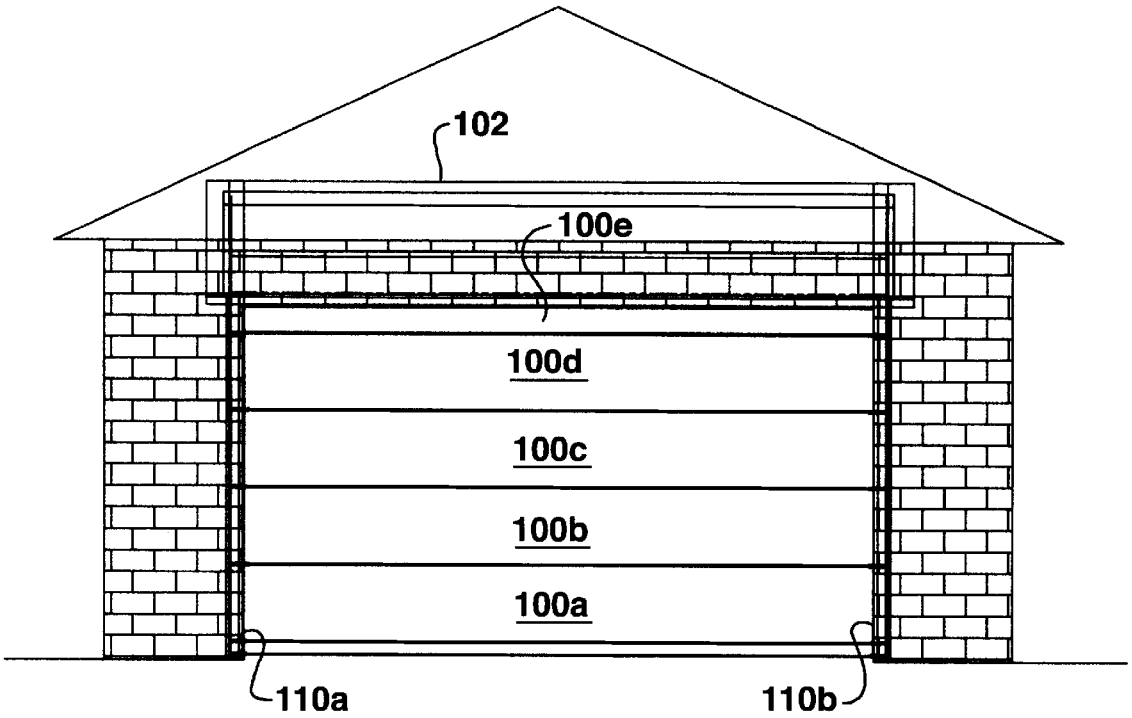
FIG. 9 is a front elevational view of the wall panel system in a lowered position.
Figure 10:
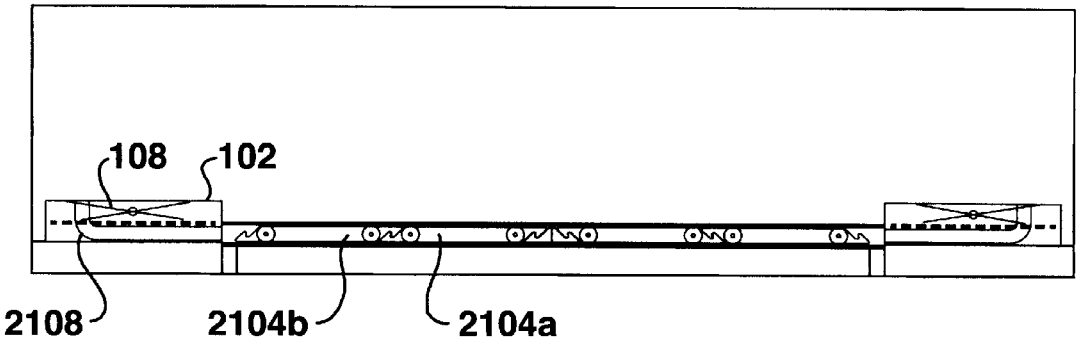
FIG. 10 is a top view of the wall panel system in a closed position.
Figure 11:
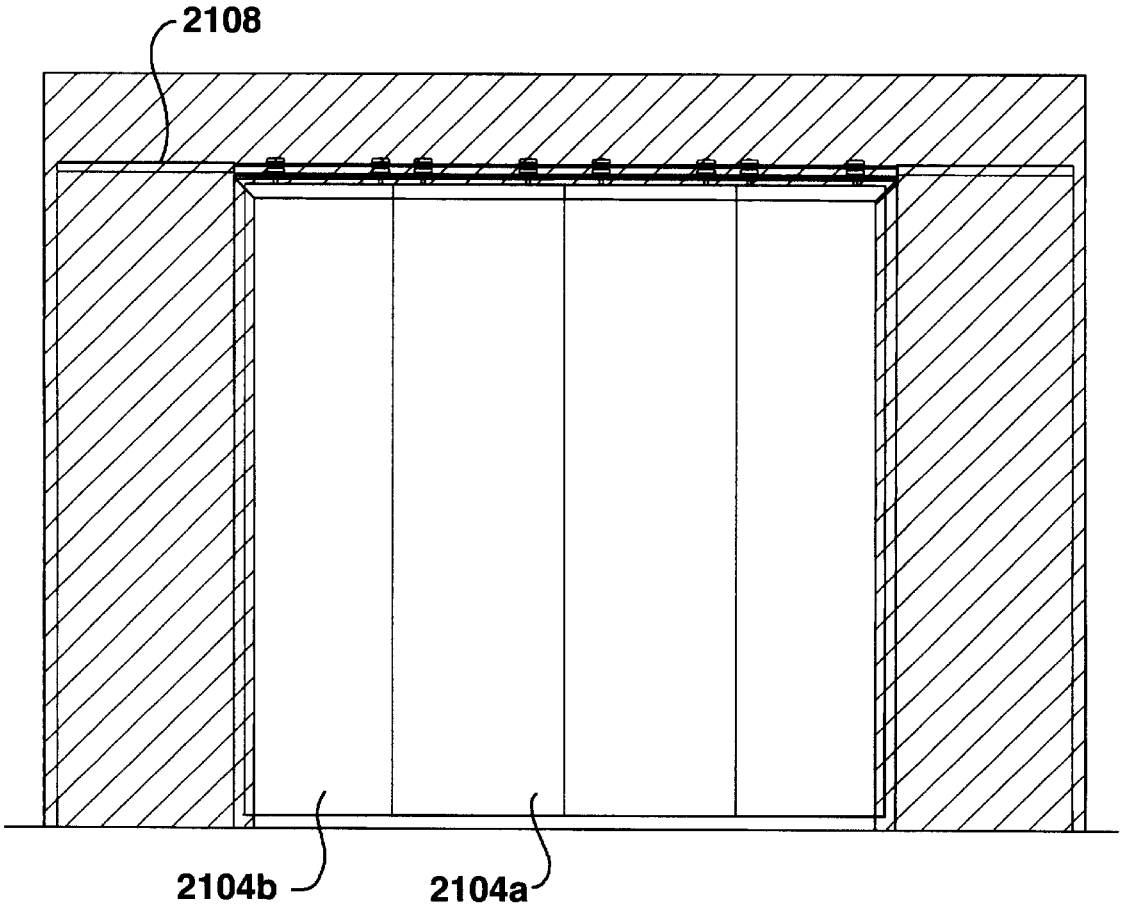
FIG. 11 is a front elevational view of the wall panel system in a closed position.
Figure 12:
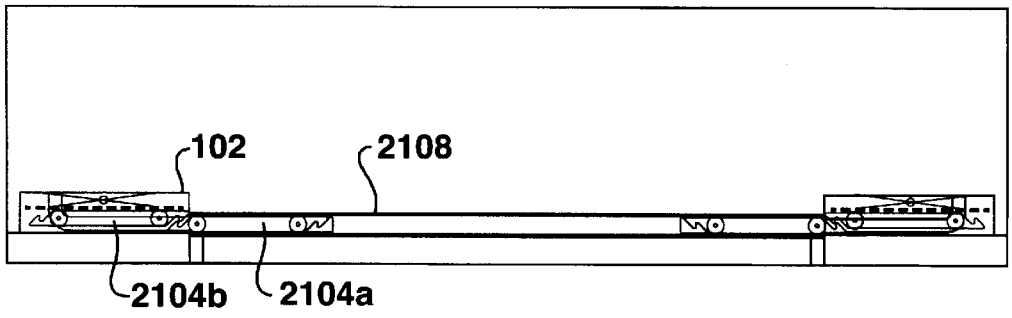
FIG. 12 is a top view of the wall panel system in a partially closed position.
Figure 13:
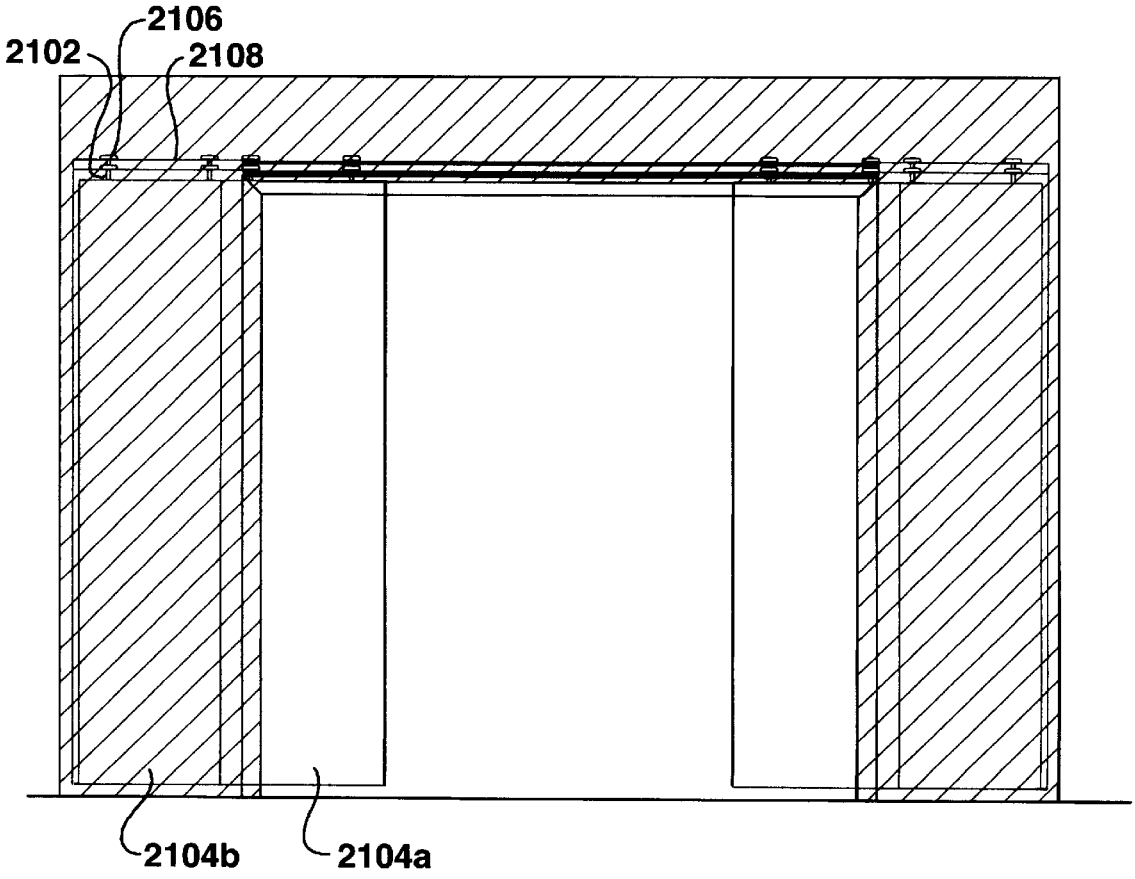
FIG. 13 is a front elevational view of the wall panel system in a partially closed position.
Figure 14:
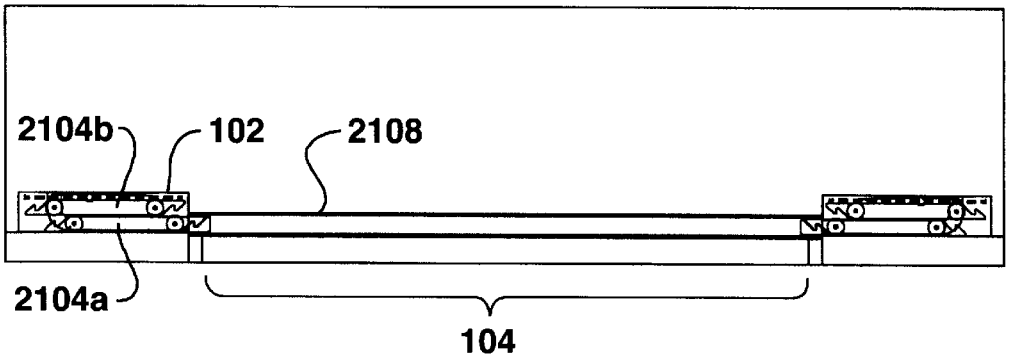
FIG. 14 is a top view of the wall panel system in an open position.
Figure 15:
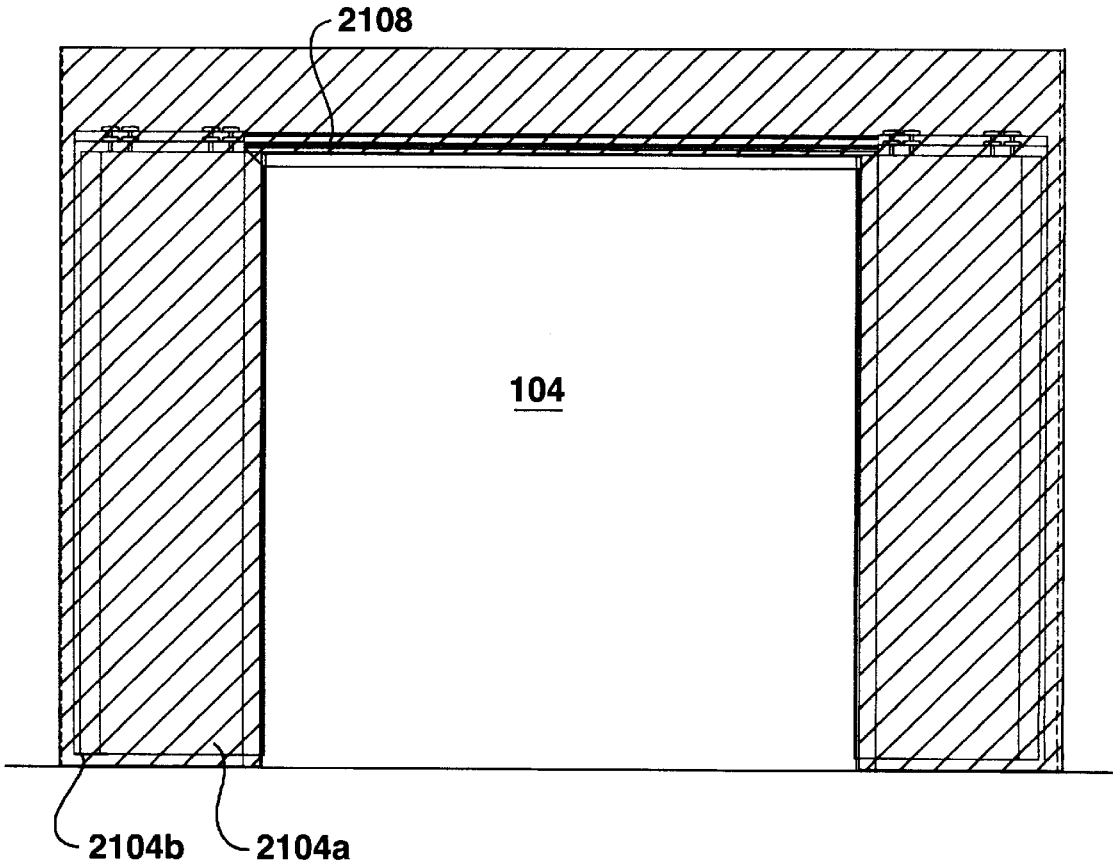
FIG. 15 is a front elevational view of the wall panel system in an open view.

FIGS. 7 through 9 illustrate an exemplary vertical up-and-down embodiment of the present invention.

Figure 21:
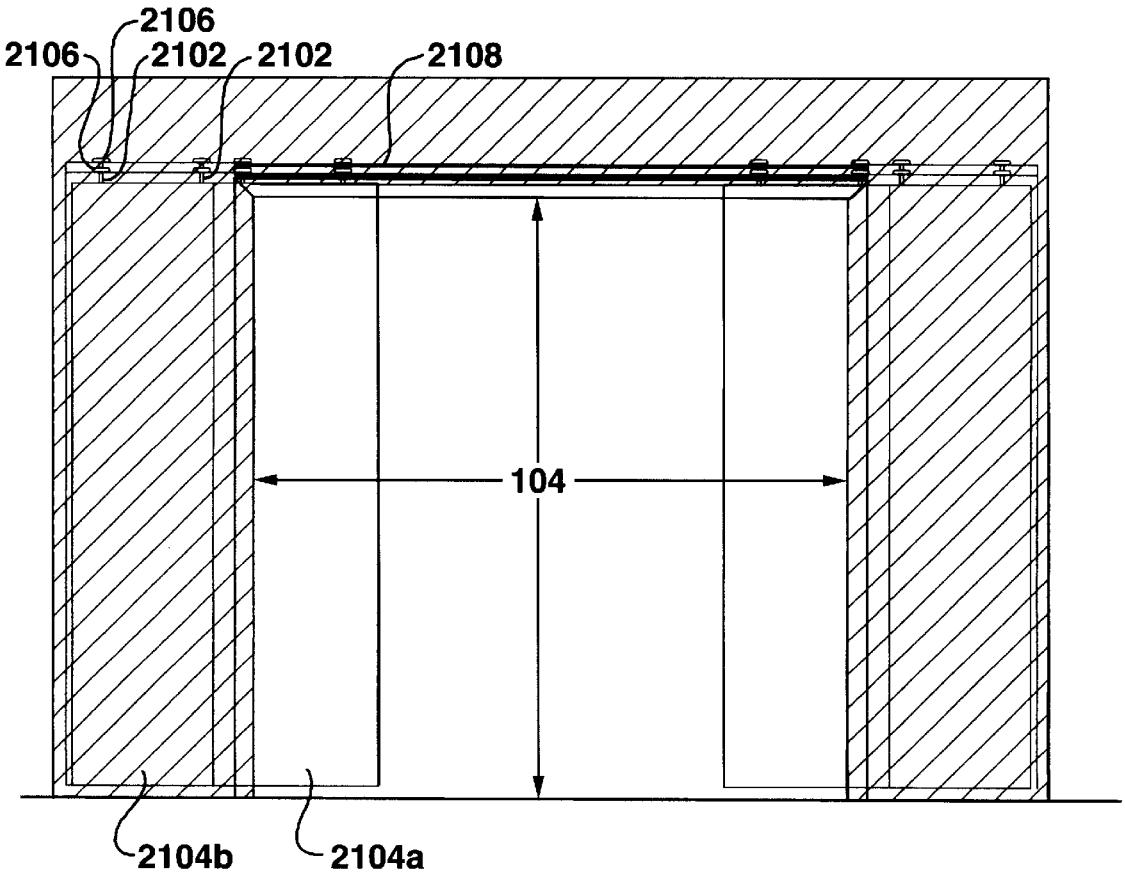
FIG. 21 is a front elevational view of the wall panel system in a partially open position.
Figure 22:
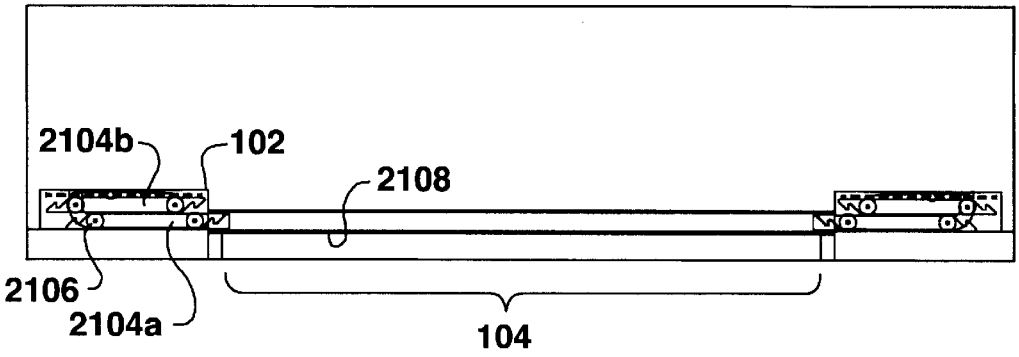
FIG. 22 is a top view of the wall panel system in an open position.
Figure 23:
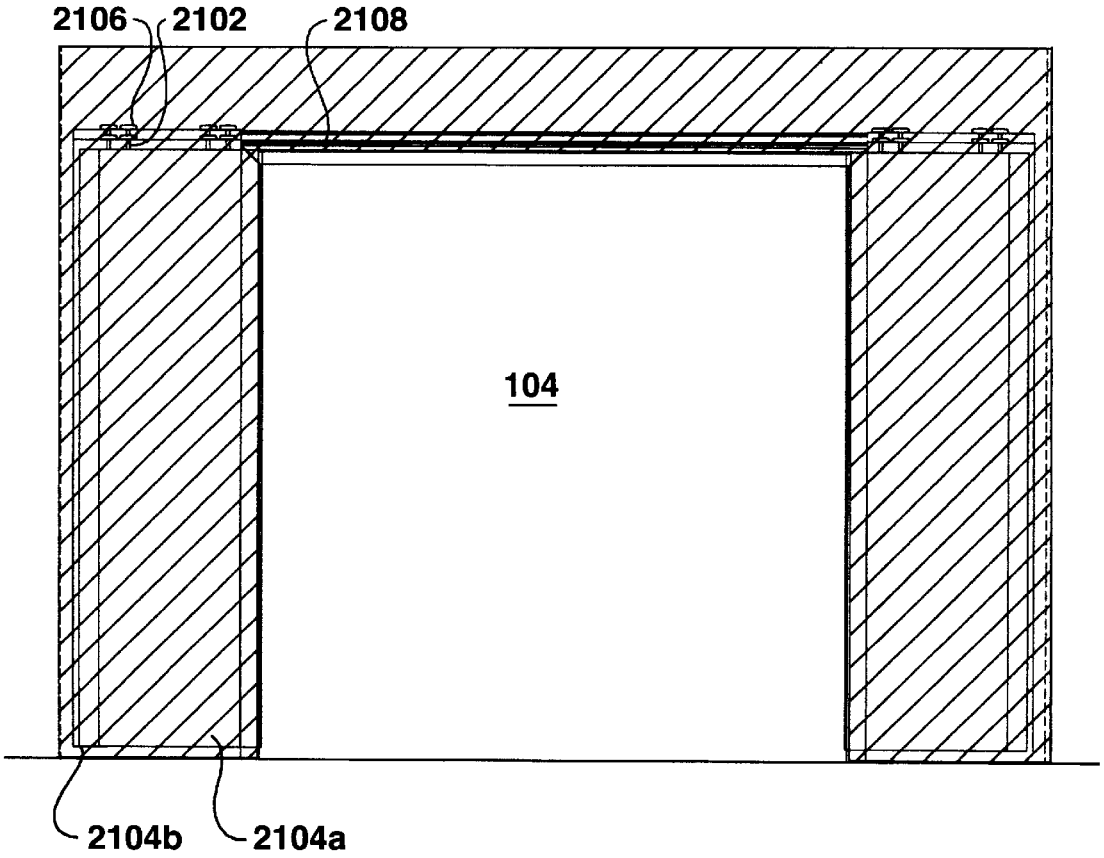
FIG. 23 is a front elevational view of the wall panel system in an open position.

FIGS. 10 through 15 and FIGS. 20 through 23 illustrate an exemplary vertical side-to-side embodiment of the present invention, which is, in a particular embodiment, used as a closet door. In FIG. 21, two vertical shafts 2102 are attached to the top edge of each panel 2104*a* and 2104*b*. Two wheels 2106 are attached to each shaft 2102. The wheels 2106 ride on opposite ledges (one per wheel) within the "C" shaped track 2108 attached above the aperture 104. When stored in the storage container 102 (see FIG. 22), the back panel 2104*b* is biased toward the front panel 2104*a* (see FIG. 22). When removed from the storage container 102 (see FIG. 20), the back panel 2104*b* wheels 2106 are guided by a curved track section 2108 which aids in engaging the back panel 2104*b* with the front panel 2104*a* as it slides past.

Figure 16:
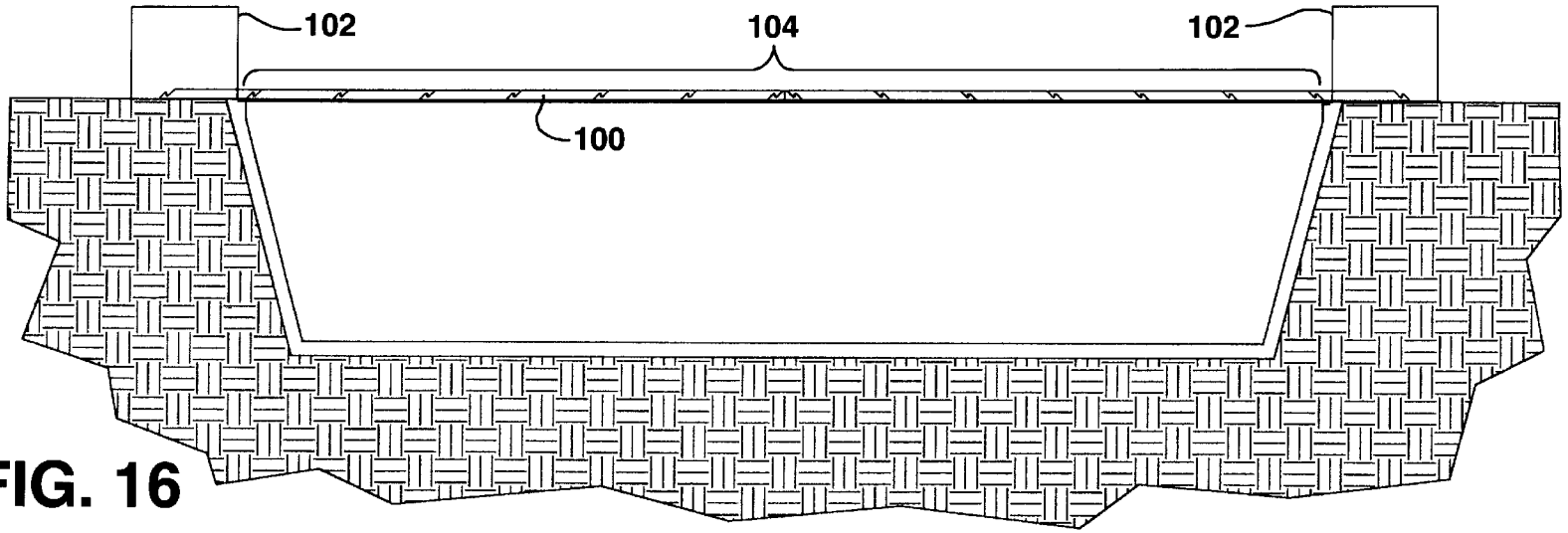
FIG. 16 is a broken-away side elevational view of the wall panel system in a closed position.
Figure 17:
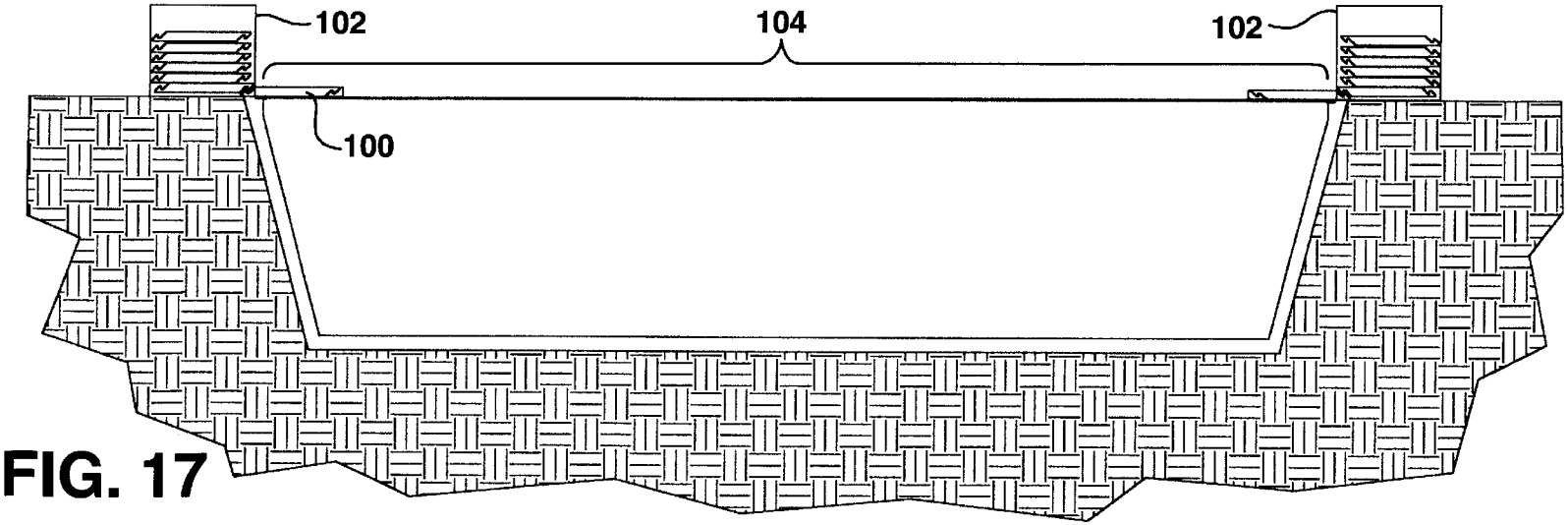
FIG. 17 is a broken-away side elevational view of the wall panel system in a partially open position.
Figure 18:
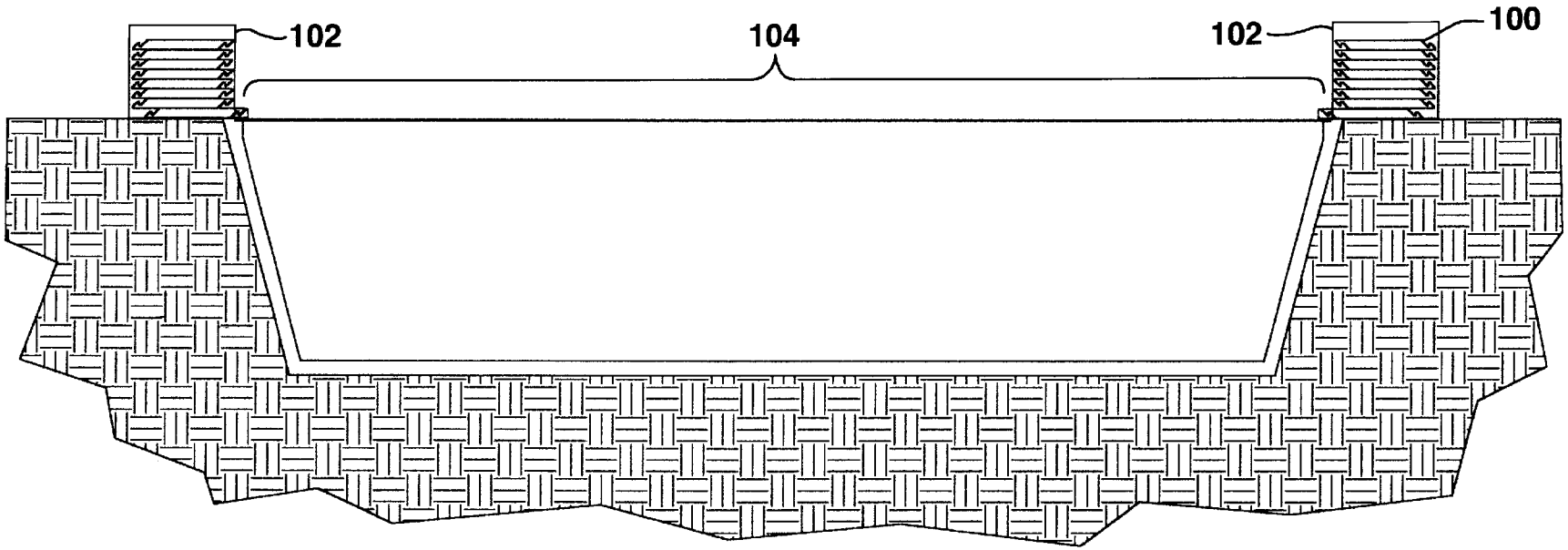
FIG. 18 is a broken-away side elevational view of the wall panel system in an open position.
Figure 19:
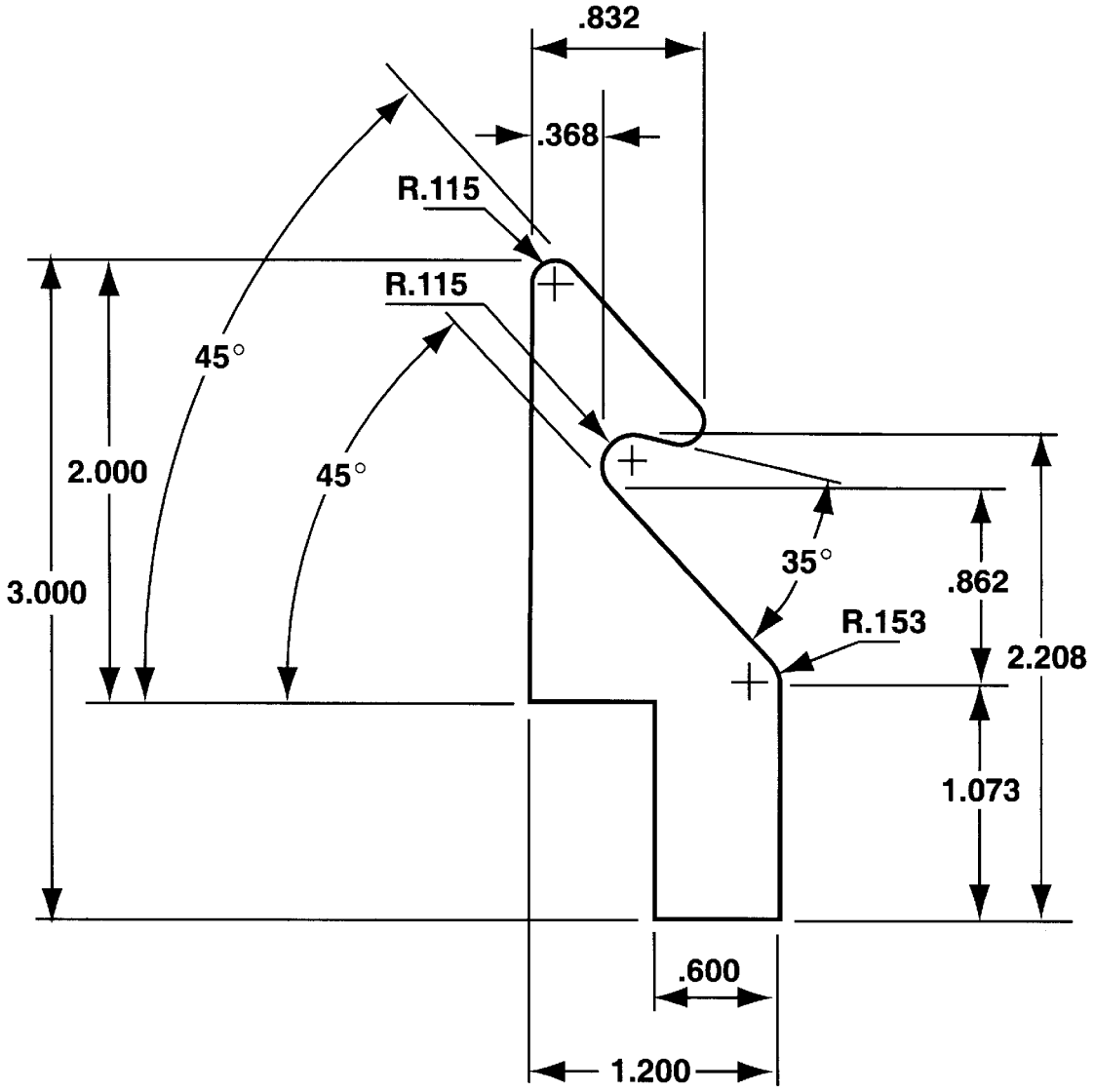
FIG. 19 is an exploded view of the joint of the wall panel system.
Figure 20:
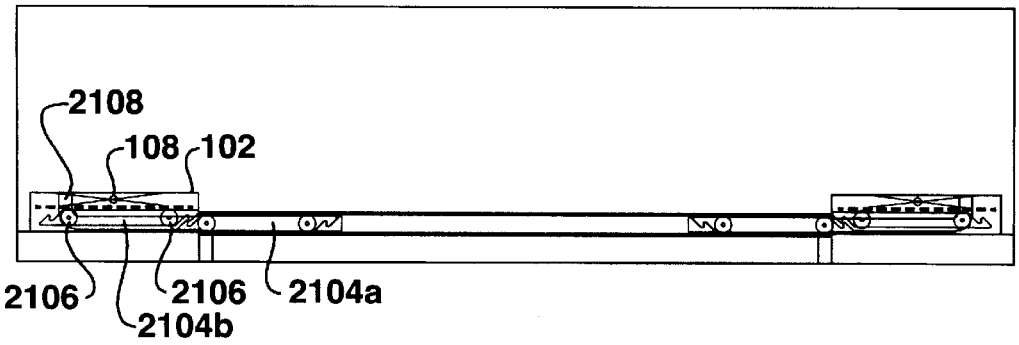
FIG. 20 is a front view of the wall panel system in a partially open position.

FIGS. 16–18 illustrate an exemplary horizontal embodiment of the present invention. One or more storage containers 102 are located above or below ground level. A toothed belt or other drive mechanism can be located under the panels 100 on one or both sides of the aperture 104. A SERAPID (meaning "chains that push") brand or another powered drive can be used to push/pull the lead panel or to drive the toothed belt or other drive mechanism. Above ground storage containers 102 may be disguised as benches, equipment storage boxes, or planters for flowers.

Other exemplary embodiments of the claimed invention (not illustrated) include: security doors, aircraft hanger doors, shutters, automobile doors, flat roofs, sloped roofs, arched roofs, domed roofs, automotive roofs, dance floors, ice skating rinks, machine way is covers, auditorium walls, gymnasium walls, arena walls, convention hall walls, cylindrical buildings, dome buildings, green houses, mobile buildings, bridges, and missile silo doors.

The panels can be constructed of a variety of conventional building materials such as, e.g., metal, glass, wood, plastic, or fiberglass.

While the invention has been particularly shown and described with reference to preferred embodiments thereof, it will be understood by those skilled in the relevant art that various changes in form and details may be made therein without departing from the spirit and scope of the invention.

What is claimed is:

1. An aperture covering comprising:

at least two interconnectable, but not fixedly connected panels, each panel having a surface that defines a plurality of notches and each panel having interlocking edges wherein the bottom edge of one panel releasably interlocks with the top edge of another panel in a way that, when interlocked, force exerted on one panel results in force being exerted on the proximate panels;

a storage area for storing said panels when said covering is in an open position;

at least one track positioned along a path within which edges of said panels move when said cover is moved from an open to a closed position; and a toothed belt which is positioned in said track and which mates with said panel notches;

wherein said panels are stacked in said storage area and removed one at a time in such a manner that, upon removal of a first panel from said storage area and into said track, said first panel interlocks with a second panel, forcing said second panel from said storage area into said track, wherein interlocking and removal of said panels continues until all said panels are removed or said first panel reaches the end of said track, resulting in said aperture covering being in the aperture-covered position, and wherein the toothed belt extends substantially the full length of the track.

2. The aperture covering according to claim 1, wherein said storage area includes a biasing means.

3. The aperture covering according to claim 1, wherein said storage area includes a compressed spring situated at the rear of said storage area, wherein said spring forces said panels toward the front of said storage area.

4. The aperture covering according to claim 1, wherein said storage area comprises a downwardly sloping storage area bottom, wherein said bottom uses gravity to force said panels toward the front of said storage area.

5. The aperture covering according to claim 1, wherein said toothed belt in one track is permanently attached to the first panel and said toothed belt in the other track is coiled in a spiral fashion around a flanged drum attached to a horizontal shaft which rotates in bearings within a compartment above the storage area.

6. The aperture covering according to claim 1, wherein said toothed belts and said notched panels prevent panel jamming by forcing said panel ends to move in a synchronous fashion within said track.

7. The aperture covering according to claim 1, wherein said panels are constructed of heavy-weight material.

8. The aperture covering according to claim 1, wherein a plurality of tracks are positioned along a path within which edges of said panels move when said covering is moved from an open to a closed position.

9. The aperture covering according to claim 1, wherein said panels have curvature.

10. An aperture covering comprising:

at least two interconnectable panels, but not fixedly connected panels, each panel having interlocking edges wherein the bottom edge of one panel releasably interlocks with the top edge of another panel in a way that, when interlocked, force exerted on one panel results in force being exerted on the proximate panels, wherein each panel has at least one notch;

at least one ball cable connected to said panels, wherein the ball cable has protrusions engaging the notches of the panels;

a storage area for storing said panels when said covering is in an open position;

at least one track positioned along a path within which edges of said panels move when said cover is moved from an open to a closed position; and a drive mechanism for exerting force upon said cables connected to said panels;

wherein said panels are stacked in said storage area and removed one at a time in such a manner that, upon removal of a first panel from said storage area and into said track, said first panel interlocks with a second panel, forcing said second panel from said storage area and into said track, wherein interlocking and removal of said panels continues until all said panels are removed or said first panel reaches the end of said track, resulting in said aperture covering being in the aperture-covered position, wherein the ball cable extends substantially the full length of the track, and wherein the track extends substantially from one end of the aperture to the other end of the aperture.

11. The aperture covering according to claim 10, wherein said storage area includes a biasing means.

12. The aperture covering according to claim 10, wherein said storage area includes a compressed spring situated at the rear of said storage area, wherein said spring forces said panels toward the front of said storage area.

13. The aperture covering according to claim 10, wherein said storage area comprises a downwardly sloping storage area bottom, wherein said bottom uses gravity to force said panels toward the front of said storage area.

14. The aperture covering according to claim 10, wherein one or more cables are attached to one or more of said panel ends such that said panel ends are forced to move in a synchronous fashion within the track.

15. The aperture covering according to claim 10, wherein said panels are constructed of heavy-weight material.

16. The aperture covering according to claim 10, wherein force is applied to said cables by a motorized drive system.

17. The aperture covering according to claim 10, wherein a plurality of tracks are positioned along a path within which edges of said panels move when said covering is moved from an open to a closed position.

18. The aperture covering according to claim 10, wherein said panels have curvature.

19. The aperture covering according to claim 1, wherein said panels have interlocking edges such that, when said panels are being returned to the storage area, the outermost edge of said panel proximate to said panel closest to the storage area, said panel proximate to said panel closest to said storage area still contained in said track, exerts force on the mating groove of said panel closest to said storage area, causing said panel closest to said storage area to be moved toward said storage area, while still remaining partially engaged to said panel proximate to said panel closest to the storage area; and as said panel proximate to said panel closest to said storage area continues to move toward said storage area, the mating groove of said panel proximate to said panel closest to said storage area exerts force on said mating groove of said panel closest to said storage area and causes said panel closest to said storage area to completely disengage from said panel proximate to said panel closest to said storage area, resulting in said panel closest to said storage area being stored therein, wherein disengagement and storage of said panels continues until all said panels are in said storage area.

20. The aperture covering according to claim 10, wherein said panels have interlocking edges such that, when said panels are being returned to the storage area, the outermost edge of said panel proximate to said panel closest to the storage area, said panel proximate to said panel closest to said storage area still contained in said track, exerts force on the mating groove of said panel closest to said storage area, causing said panel closest to said storage area to be moved toward said storage area, while still remaining partially engaged to said panel proximate to said panel closest to the storage area; and as said panel proximate to said panel closest to said storage area continues to move toward said storage area, the mating groove of said panel proximate to said panel closest to said storage area exerts force on said mating groove of said panel closest to said storage area and causes said panel closest to said storage area to completely disengage from said panel proximate to said panel closest to said storage area, resulting in said panel closest to said storage area being stored therein, wherein disengagement and storage of said panels continues until all said panels are in said storage area.

* * * * *